US005388970A

United States Patent [19]

Muckelmann et al.

[11] Patent Number: 5,388,970

[45] Date of Patent: Feb. 14, 1995

[54] ELECTRICALLY DRIVEN AIR PUMP

[75] Inventors: Klaus Muckelmann; Michael Bonse, both of Düsseldorf; Günter Van De Venne, Mönchengladbach, all of Germany

[73] Assignee: Pierburg GmbH, Neuss, Germany

[21] Appl. No.: 185,713

[22] Filed: Jan. 24, 1994

[30] Foreign Application Priority Data

Jan. 22, 1993 [DE] Germany ..... 4301666

[51] Int. Cl.[6] ..... F04B 17/00

[52] U.S. Cl. ..... 417/363; 417/371; 415/208.1

[58] Field of Search ..... 417/363, 370, 371; 415/208.1

[56] References Cited

U.S. PATENT DOCUMENTS

| | | | |
|---|---|---|---|
| 1,460,146 | 6/1923 | Spielman . | |
| 1,809,603 | 6/1931 | Reed | 417/363 |
| 2,316,608 | 4/1943 | McMahan . | |
| 2,333,226 | 11/1943 | Anderson et al. | 417/363 |
| 2,454,570 | 11/1948 | Rector | 417/363 |
| 2,857,849 | 10/1958 | Pezzillo | 417/363 |
| 2,993,449 | 7/1961 | Harland | 417/371 |
| 3,421,446 | 1/1969 | Strscheletzly et al. | 415/208.1 |
| 3,926,537 | 12/1975 | Piper | 417/363 |
| 4,309,155 | 1/1982 | Heinz et al. | 417/363 |
| 4,452,562 | 6/1984 | Hsu | 415/208.1 |

FOREIGN PATENT DOCUMENTS

| | | | |
|---|---|---|---|
| 0547112 | 10/1957 | Canada | 417/371 |
| 0385298 | 9/1990 | European Pat. Off. . | |
| 0692591 | 6/1940 | Germany | 417/363 |
| 8716074 | 3/1988 | Germany . | |
| 4107049 | 9/1992 | Germany . | |
| 2060069 | 4/1981 | United Kingdom . | |
| 9110068 | 7/1991 | WIPO . | |

*Primary Examiner*—Richard A. Bertsch
*Assistant Examiner*—M. Kocharov
*Attorney, Agent, or Firm*—Ladas & Parry

[57] ABSTRACT

An electrically driven air pump having a housing, a pump mechanism in the housing and an electric motor in the housing connected in driving relation to the pump mechanism. Two spaced elastic supports support the electric motor from the housing at opposite ends of the motor. An air passage in the housing provides a flow of air past the electric motor to the pump mechanism. The air passage includes a suction nozzle supported by one of the elastic supports for supplying air to an inlet collar of a pump impeller of the pump mechanism. The suction nozzle projects into the collar for supply of the air from the electric motor to the pump mechanism.

8 Claims, 1 Drawing Sheet

ELECTRICALLY DRIVEN AIR PUMP

FIELD OF THE INVENTION

The invention relates to an electrically driven pump and particularly to an air pump for a motor vehicle to pump so-called secondary air into the exhaust gas system to improve the properties of the exhaust gases.

BACKGROUND AND PRIOR ART

An air pump is disclosed in EPA 0 385 298 Al, which has the disadvantage of producing vibrations which are transferred to the pump support or the apparatus receiving the secondary air to create high frequency noise during use because of an unequal distribution of mass in the pump impeller and in the electric motor and the magnetic rotary field which arises.

Recently, noise from the drive means of motor vehicles has been reduced considerably whereby any noise from the air pump becomes audible in the passenger compartment of the vehicle and this is undesirable.

In order to reduce this noise, DE-A1 41 07 049.6 proposes that the electric motor be supported by means of two elastic supports placed between the electric motor and the housing.

Although these means lead to a significant reduction in noise, irregularly occurring rattling noises are nevertheless produced during particular phases of operation due to the fact that an inlet collar located on the impeller, and projecting over an air inlet support, impacts against the supports, which are securely attached to the pump housing, especially during extended low frequency rotation with a large amplitude.

SUMMARY OF THE INVENTION

An object of the invention is to provide an air pump having reduced operational noise and, in addition, having simplified construction.

The above and further objects of the invention are achieved by the construction of an electrically driven air pump comprising a housing, pump means in said housing, an electric motor in said housing connected in driving relation to said pump means, two spaced elastic supports supporting the electric motor from the housing, an air passage being formed in the housing for flow of air past the electric motor to the pump means, said air passage including a suction nozzle supported by one of the elastic supports and communicating with an air inlet collar on the pump means to supply air thereto. The suction nozzle projects into the collar for supply of air from the electric motor into the pump means.

In further accordance with the invention, the suction nozzle is in the form of a funnel whose wider end is connected: to the said one of said elastic supports, the narrower end of the funnel being engaged in the air inlet collar which is attached to an impeller of the pump means.

The air passage is formed by slots provided in both elastic supports so that air can travel past the drive motor then to the funnel for supply to the pump impeller.

The air pump has an air inlet connected to an annular duct in the housing which forms part of the air passage and the air travels from the annular duct through a filter element to the air chamber surrounding the drive motor via the slots in the other of the elastic supports.

The housing contains a widened region extending from the annular duct, but preferably sealed therefrom, and an electrical connection plate is secured in the widened region and is connected by flexible cables to the electric motor and by electrical connector lines externally of the housing.

DETAILED DESCRIPTION OF A PREFERRED EMBODIMENT

Figure 1:
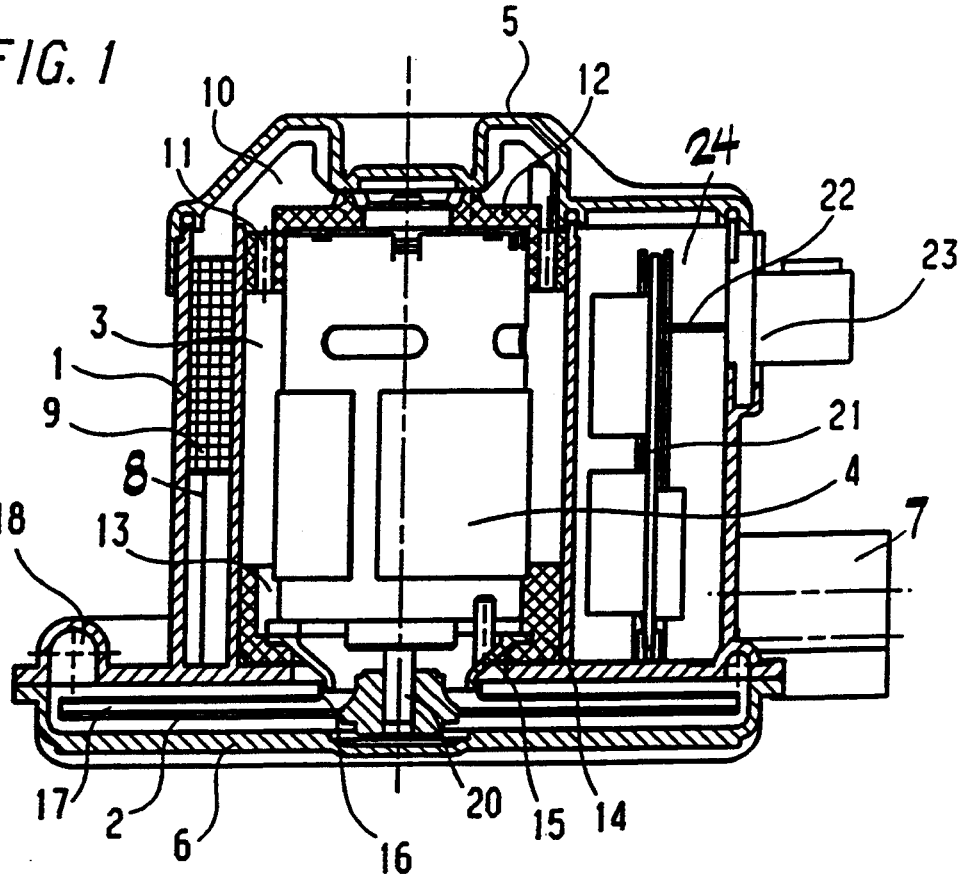
FIG. 1 is a longitudinal sectional view of an air pump according to the invention.
Figure 2:
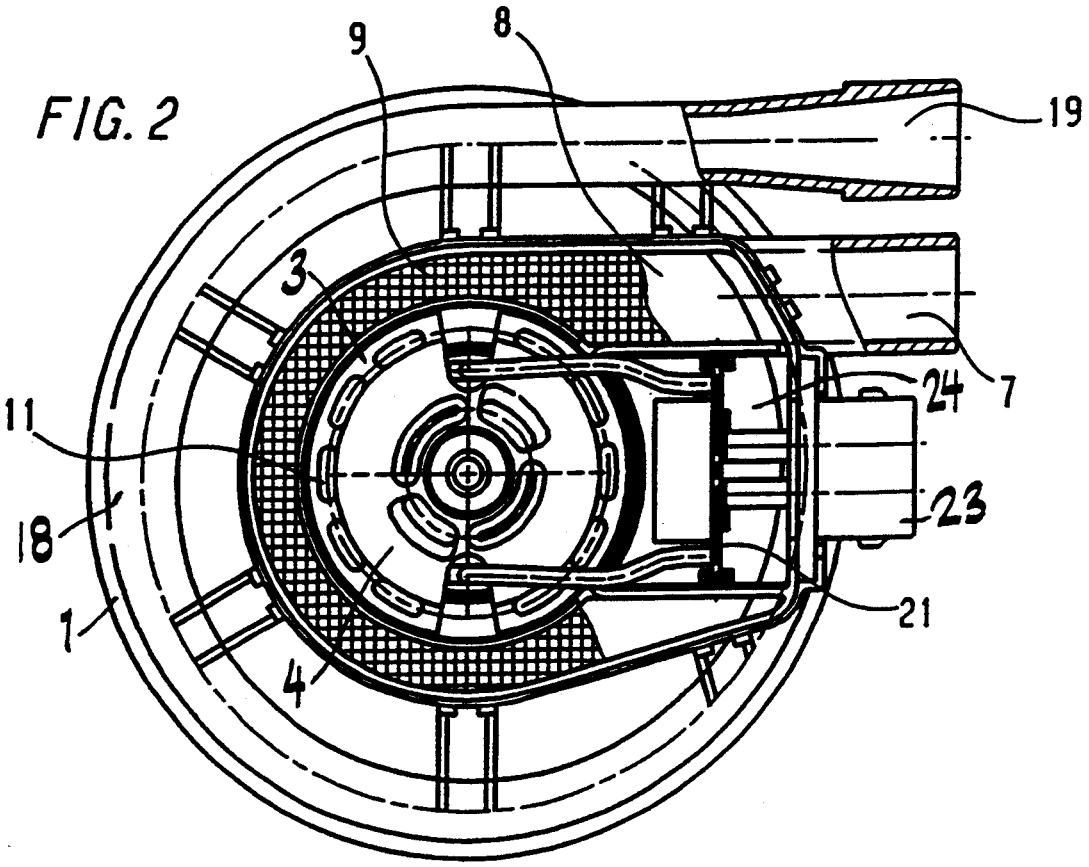
FIG. 2 is an end view of the pump, partly broken away and in section.

In the drawing, there is seen an air pump in accordance with the invention which consists of a housing 1 made of plastic which accommodates a pump mechanism 2 and an electric motor 4 in a chamber 3. The housing 1 is closed on the motor side by a lid 5 and on the pump side by a lid 6.

The housing 1 has an air inlet connection 7 which opens into an annular duct 8 arranged around the chamber 3 of the electric motor. Starting from this annular duct 8, the air which is sucked in at inlet connection 7 passes through a filter element 9 into a chamber 10 which is formed by the lid 5 and then into the electric motor chamber 3 via a plurality of slots 11 formed in an elastic motor support 12 at the upper end of the electric motor 4. The air then passes from the chamber 3, via a plurality of slots 13 in a second elastic motor support 14 at the lower end of the motor into a suction nozzle in the form of a funnel 15 which is attached to the motor support 14. A portion of the air stream in chamber 3 flows through air cooling channels (not shown) in the electric motor 4 and recombines with the remainder of the air stream. The upper, wider end of the suction funnel 15 projects into an inlet attached to the elastic support 14 and its lower narrow end projects into an inlet collar 16 of a pump impeller 17 to supply the air thereto. The rotating impeller 17 sucks in the air via the funnel 15 and pumps the air into an annular duct 18 arranged in the housing 2 partially surrounding the perimetral edge of the impeller 17. The air flows from duct 18 to a pressure connection 19 and then to a consumption means (not shown) which can be the exhaust gas system of an internal combustion engine. The impeller 17 is drivingly attached to a shaft 20 of the electric motor 4.

The end of duct 8 remote from inlet connection 7 opens into a widened region 24 in which a connection plate 21 is fixed whose electrical connectors 22 extend externally of the housing via a plug-in connection 23 arranged in the wall of the housing. The widened region 24 is advantageously sealingly closed relative to the other part of the annular duct 8 in order to protect the plate 21 against moisture.

The connector lines between the plate 21 and the electric motor 4 are in the form of flexible cables.

During operation of the air pump and as a result of external effects from intermittent loads on the pump, the electric motor 4 and the impeller 17 produce low frequency vibrations of large amplitude. As a result of the construction in accordance with the invention, the suction funnel 15 which is arranged at the motor support 14 follows this movement directly so that impacting of the inlet collar 16 of the impeller 17 at the suction funnel 15 can be eliminated. This arrangement also permits a reduction in the play between the collar 16 and the suction funnel 15 as a result of which leakage or back flow of air from the annular duct 18 into the suction funnel 15 or the collar 16 is minimized.

By virtue of the construction of the air pump in accordance with the invention, reduced operation noise has become possible since vibrations caused by the pump mechanism and the electric motor of low frequency and large amplitude are cushioned in the motor supports and no longer are transmitted to the housing 1 to any large extent. In addition, the air pump is made simple in construction by means of the invention and it is capable of being manufactured at relatively low cost while having a long life. Smaller tolerances are now also possible in the pump mechanism which increases the efficiency of pumping.

Although the invention has been described with reference to one embodiment thereof, it will become apparent to those skilled in the art that numerous modifications and variations can be made without departing from the scope and spirit of the invention as defined in the attached claims.

What is claimed is:

1. An electrically driven air pump comprising a housing, pump means in said housing, an electric motor in said housing connected in driving relation to said pump means, two spaced elastic supports supporting the electric motor from the housing, means in said housing providing an air passage for flow of air past said electric motor and to said pump means, said passage including a suction nozzle supported by one of said elastic supports, said pump means having an inlet collar for entry of air into the pump means, said suction nozzle projecting into said collar for supply of air from the air passage into said pump means, said pump means comprising an impeller provided with said inlet collar, said one of said elastic supports being provided with a plurality of slots through which the air passes to said nozzle.

2. An electrically driven air pump as claimed in claim 1, wherein said nozzle has a wide end at which the nozzle is supported by said one of said elastic supports and a narrow end which projects into said collar.

3. An electrically driven air pump as claimed in claim 2, wherein said passage for the air includes an inlet, an annular duct connected to said inlet, and an air chamber surrounding the electric motor, said air pump further comprising a filter element in said annular duct to filter air traveling from said annular duct to said air chamber surrounding the electric motor.

4. An electrically driven air pump as claimed in claim 3, wherein said air passage comprises a plurality of slots provided in the other of said elastic supports for conveying air from said annular duct to said air chamber surrounding the electric motor.

5. An electrically driven air pump as claimed in claim 4, wherein said air passage further comprises a further air chamber between an end of the motor supported by the other of said elastic supports and a closure lid facing said end of the motor, said further air chamber communicating with said annular duct upstream of said filter element and said slots in said other of said elastic supports.

6. An electrically driven air pump as claimed in claim 3, wherein said housing has a widened region extending from said annular duct, said air pump further comprising a connection plate secured in said widened region, flexible cables connecting said electric motor to connectors on said plate, and electrical connection means connecting said connections externally of said housing.

7. An electrically driven air pump as claimed in claim 6, wherein said electrical connection means comprises a plug-in connection connected to said housing at the outside thereof.

8. An electrically driven air pump as claimed in claim 6, wherein said widened region is sealed from said annular duct to prevent air flow therebetween.

* * * * *